United States Patent [19]

Hartelius et al.

[11] Patent Number: 4,563,573

[45] Date of Patent: Jan. 7, 1986

[54] TOY ELECTRIC OVEN

[75] Inventors: Mark E. Hartelius, Rochester; Randall J. Jacobs, New Baltimore, both of Mich.

[73] Assignee: CPG Products Corp., Minneapolis, Minn.

[21] Appl. No.: 564,948

[22] Filed: Dec. 23, 1983

[51] Int. Cl.[4] ..... H05B 1/02; F24C 7/04

[52] U.S. Cl. ..... 219/405; 219/506; 219/411; 219/521; 126/192; 99/337; 374/205

[58] Field of Search ..... 219/405, 408, 411, 412, 219/413, 414, 354, 521, 343, 347, 391, 395, 398, 410, 506; 99/337, 341, 331, 333; 126/275 R, 275 E, 190, 197, 192, 200; 374/149, 195, 187, 205; 116/216, 221; 49/1, 31; 110/177; 200/50 A, 50 R

[56] References Cited

U.S. PATENT DOCUMENTS

| | | | |
|---|---|---|---|
| 477,313 | 6/1892 | Sears | 374/195 |
| 682,472 | 9/1901 | Lemmon | 374/195 |
| 989,842 | 4/1911 | Goodrich | 126/275 R |
| 1,135,358 | 4/1915 | Cole | 200/50 A |
| 1,179,340 | 4/1916 | Smith | 219/395 |
| 1,388,974 | 8/1921 | Schreiber | 126/275 E |
| 1,712,330 | 5/1929 | Chamales | 219/521 |
| 2,177,101 | 10/1939 | Franzwa | 219/521 |
| 2,864,932 | 12/1958 | Forrer | 219/410 |
| 2,895,405 | 7/1959 | Hopkins | 99/337 |
| 3,075,396 | 1/1963 | Smith | 200/330 |
| 3,227,065 | 1/1966 | Litman | 99/341 |
| 3,368,063 | 2/1968 | Kuhn | 219/405 |
| 3,548,146 | 12/1970 | Hoyland | 219/408 |
| 3,625,197 | 12/1971 | Pirker | 126/197 |
| 4,163,443 | 8/1979 | Peterson | 126/197 |
| 4,249,067 | 2/1981 | Cummings | 219/405 |
| 4,273,992 | 6/1981 | Thomas | 219/405 |

FOREIGN PATENT DOCUMENTS

| | | | |
|---|---|---|---|
| 1200765 | 9/1965 | Fed. Rep. of Germany | 126/190 |
| 2004211 | 9/1970 | Fed. Rep. of Germany | 126/197 |

*Primary Examiner*—C. L. Albritton
*Assistant Examiner*—Teresa J. Walberg
*Attorney, Agent, or Firm*—G. O. Enockson; L. MeRoy Lillehaugen

[57] ABSTRACT

The toy electric oven has a chamber. In the lower portion of the chamber there is a chandelier bulb surrounded by a parabolic reflector that reflects heat upwardly. A rack in the upper portion of the chamber has a lower plate with an opening therein so that heat can impinge upon the underside of a utensil. The rack also has an upper plate provided with an opening immediately beneath a window in the top of the housing so that whatever is being heated can be viewed. A slide switch is employed to supply power to the chandelier lamp. The operating button of the slide switch is actuated between its open and closed positions by means of a switch plate having an arcuate slot therein possessing a sufficient amount of eccentricity so that the operating button of the switch is moved from its open position to its closed position when said switch plate is rotated in one direction by a manually-operated knob. The switch plate includes a guard portion that is moved into obstructive relation with the entrance leading to the rack when the switch is closed. A gate is also moved into obstructive relation with the entrance by means of two bimetallic arms that, when heated sufficiently shift the gate from an open or raised position to a closed and blocking position relative to the entrance. Should the oven temperature become too high for a certain time period, then a thermal switch interrupts the power being supplied to the chandelier bulb.

27 Claims, 7 Drawing Figures

TOY ELECTRIC OVEN

BACKGROUND OF THE INVENTION

1. Field of the Invention

This invention relates generally to toy electric ovens, and pertains more particularly to an oven of this type that possesses a number of important safety features yet which is realistic in appearance.

2. Description of the Prior Art

Safety has been recognized as being of paramount importance as far as toy electric ovens are concerned. Notable amongst such prior art ovens in the patent literature is the oven described in U.S. Pat. No. 3,368,063, issued on Feb. 6, 1968 to James O. Kuhn for "TOY OVEN" and U.S. Pat. No. 4,249,067, issued on Feb. 3, 1981 to Charles A. Cummings for "TOY ELECTRIC CONVECTION OVEN." Ovens of this type have been marketed by the assignee of the present invention. Therefore, it is known that they have performed quite well. Nonetheless, the need still remains for an oven with improved safety features and which will be extremely realistic, both as to its appareance and its operation.

SUMMARY OF THE INVENTION

Accordingly, one general object of the instant invention is to provide a toy electric oven having incorporated therein certain safety features that do not detract from the realism of the toy oven.

Another object of the invention is to provide a toy electric oven that will be exceedingly efficient and effective so that but little heat is required. In this regard, the invention makes use of an electric light bulb of lower wattage than heretofore. More specifically, an aim of the invention is to provide a toy electric oven that will cook small quantities of food and heat other items when using a vertically-oriented chandelier bulb having only a 60 watt rating.

Another object, which lends realism to the toy oven, is that an oven constructed in accordance with the present invention employs but a single access opening or entrance through which items to be heated are both inserted and removed from the baking chamber. Therefore, an aim of the invention is to obviate the need of two openings as heretofore employed which detract from the oven's realism.

Yet another object of the invention, which is closely allied with the preceding object, is to provide safety measures associated with the single entrance to the baking chamber that prevents items from being either inserted or withdrawn when power is being supplied to the oven and also when the oven is at an elevated temperature sufficient to burn the child.

Still further, an object of the invention is to provide a toy electric oven of the above type that will have a heat indicator that visually signifies when the oven is hot or cold.

Also, the invention has as an object the provision of a viewing window that permits an unobstructive view of the baking process at all times.

While various safety precautions are included, it is also an object of the invention to completely remove the power from the oven should an excessive temperature be reached for a predetermined period of time.

A still further object is to provide a toy electric oven of the foregoing type that will be simple, lightweight, rugged and susceptible to being manufactured quite inexpensively.

Briefly, our invention contemplates a housing forming a baking chamber having but one entrance via which items to be cooked are both inserted and removed. Whenever the power is turned on, then a guard member is automatically interposed in the entrance so as to sufficiently obstruct the entrance so that no item can be inserted or removed once the power has been turned on. Also, inasmuch as there will be residual heat remaining after a baking period, a second guard member is thermostatically actuated into an obstructive relationship with the entrance so that the child cannot take out an item after the baking process has been terminated until the oven has cooled to a safe temperature. Excellent heating efficiency is achieved through the use of a single 60 watt electric light bulb of the chandelier type which bulb is oriented vertically within the baking chamber. A parabolic reflector is associated with the chandelier bulb to further enhance the oven's efficiency.

Inasmuch as the goal of prior art toy electric ovens has been mainly to provide a toy oven that will bake a variety of foods so that the child can imitate the baking technqiues used by its mother, it is important that the toy oven possess an overall appearance and operation as closely resembling a real full-scale oven as possible. This is achieved by using but a single access opening or entrance to the cooking or baking chamber so that the child realistically inserts the item to be heated in a manner more closely resembling a real oven and by the same token removing the item at the completion of its cooking period in a manner resembling that of a full size oven. Also contributing to the realism is a heat or temperature indicator that is closely allied with one of the safety features. Thus, a dual utilization of components is made use of, thereby providing a toy electric oven that is quite simple in its construction.

DESCRIPTION OF THE PREFERRED EMBODIMENT

Figure 1:
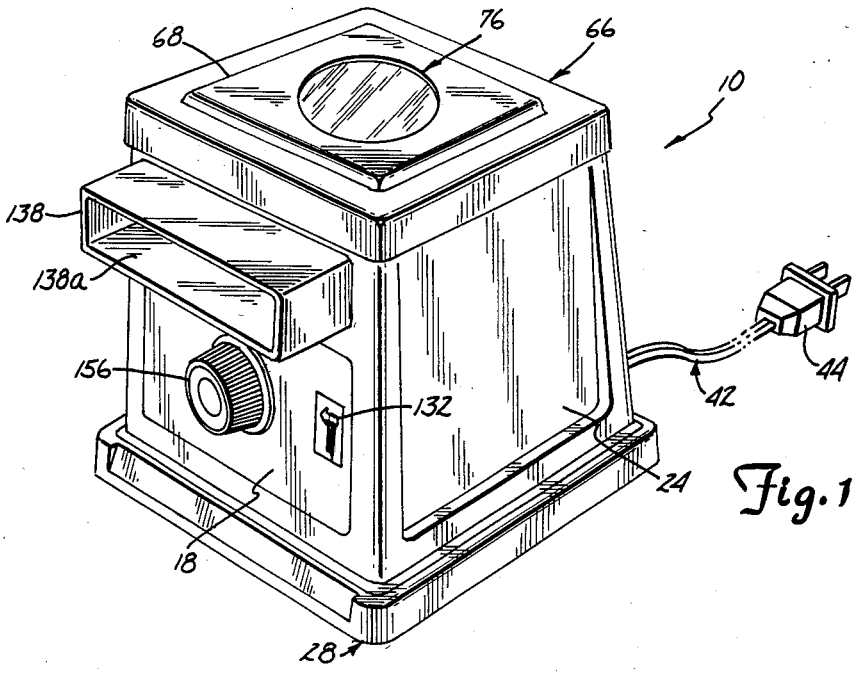
FIG. 1 is a perspective view of a toy electric oven exemplifying our invention.

The toy electric oven illustrating our invention has been denoted in its entirety by the reference numeral 10.

Included in the construction of the oven 10 is a housing 12 composed of certain parts. In this regard, the housing 12 includes a somewhat cubically-shaped casing 14 having a top wall 16, a front wall 18, a rear wall 20, side walls 22, 24 and an open bottom 26. The housing additionally includes a base 28 formed with a bottom wall 30 that has a skirt 32 depending peripherally therefrom. The bottom wall 30 has a well 34 centrally located therein.

The base 28 closes the open bottom 26 of the casing 14. In other words, the bottom wall 30 provided by the base 28 is designed to close the open bottom 26. Therefore, a plurality of screws 35 (one apearing in FIG. 4) are used to detachably fasten the base 28 to the casing 14. Stated somewhat differently, the casing 14 and the base 28 comprise the housing 12, the two being held together by means of the screws 35 to form a void or chamber denoted generally by the numeral 36.

The toy electric oven includes a vertically-oriented lamp socket 38 mounted in the lower portion of the chamber 36. In the practicing of our invention, it is intended that a 60 watt chandelier light bulb 40 be used. As the description progresses, it will become apparent that the heat generated by the chandelier bulb 40 is effeciently utilized in performing a baking operation.

Figure 2:
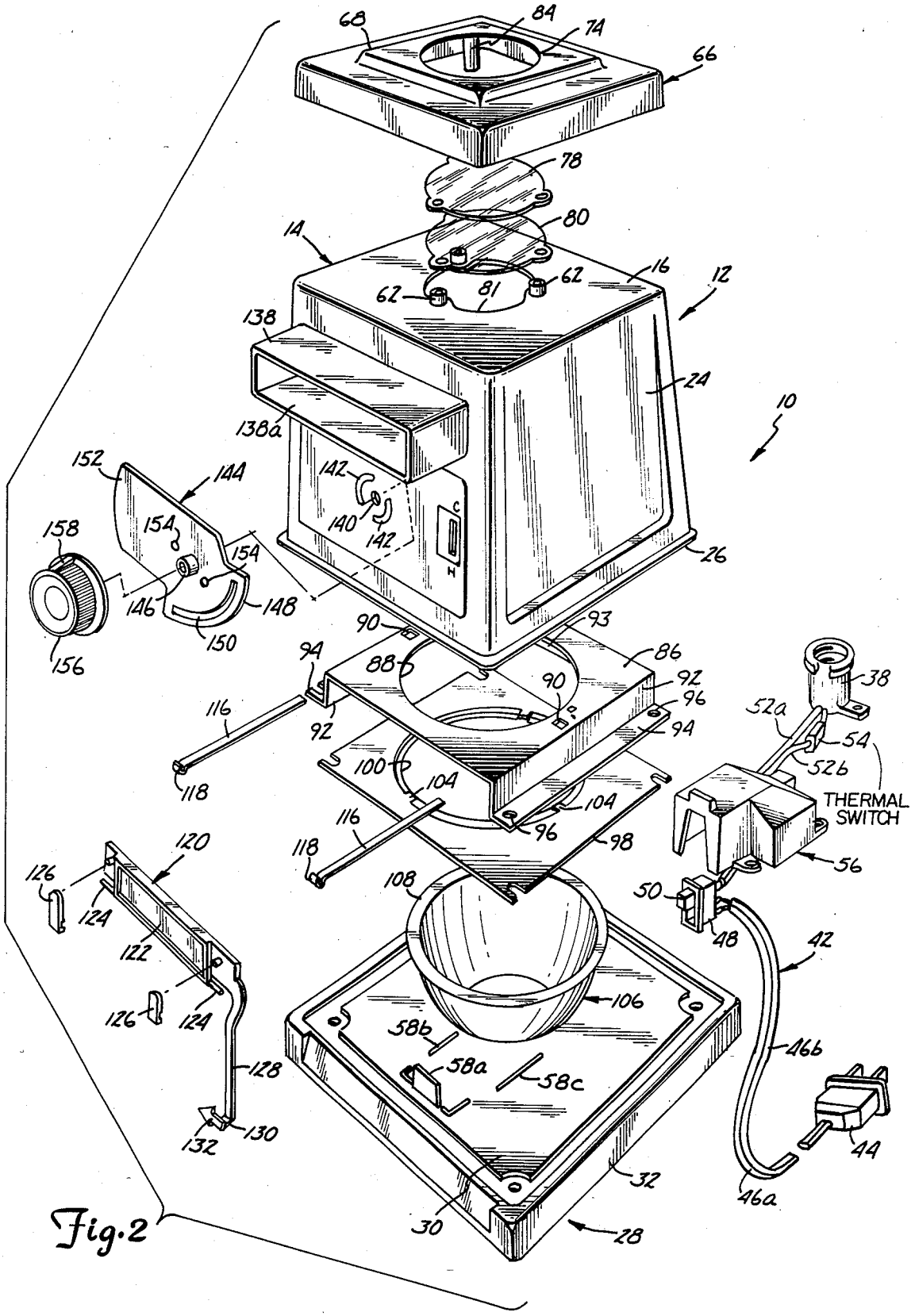
FIG. 2 is an exploded perspective view showing the most important components utilized in the practicing of the invention.

A power supply cord indicated generally by the numeral 42 is shown in FIG. 2. The power supply cord includes a conventional bayonet-type plug 44. Connected to the plug 44 are conductors 46*a* and 46*b*, the conductors 46*a*, 46*b* extending to a slide switch 48 having an operating button 50 that is slidable vertically; more specifically, when the button 50 is uppermost, the switch is open and the bulb 40 de-energized, whereas when the button 50 is moved to its lowermost position, the switch 48 is closed and the bulb 40 is energized by reason of power being supplied to the socket 38. Included in the circuit are additional conductors 52*a* and 52*b*, the conductor 52*b* having a thermal switch 54 included therein so that if an exceptionally high temperature is reached within the oven 10, then the circuit is automatically interruped so that power is no longer supplied to the socket 38 and the chandelier bulb 40 vertically mounted therein.

The slide switch 48 is held vertically by means of a switch casing 56 that is riveted to the bottom wall 30 of the base 28, there being locating lugs or ears 58*a*, 58*b* and 58*c* on the bottom wall 30 that enable the casing to be properly located at the factory. Inasmuch as other means can be employed for holding the slide switch 48 in proper position, the precise manner in wich the casing 56 is mounted is not necessary to explain.

It will be noted from FIG. 2 that a plurality of tubular bushings 62 extend upwardly from the surfce of the top wall 16. A top cover 66 is employed that overlies the top wall 16. The cover 66 includes a central raised portion 68. Extending downwardly from the raised central portion 68 are tubular bushings 70. By means of screws 72, as can be discerned from FIG. 4, the cover 66 is held in place with respect to the top wall 16. Formed in the raised central portion 68 of the top cover 66 is a circular opening 74 for a purpose described immediately below.

Having mentioned the opening 74, it will now be explained that a window denoted generally by the reference numeral 76 functions as a viewing window so that the child can unobstructively see what is occurring during the baking procedure. The window 76 includes two clear plastic lenses 78 and 80, the lens 78 being directly associated with the opening 74 and the plastic lens 80 being associated with a central opening 81 formed in the top wall 16. As just indicated, the window 76 provides a easy way for the child to observe what is taking place during a baking operation.

Only the upper portion of the chamber 36 is used for the actual baking operation. In this regard, the toy oven 10 includes a rack 82 providing a cooking compartment for slidably holding a utensil in the form of a pan or tray (not shown). The rack 82 is suspended by means of tubular mounts or legs 84 that extend downwardly from the underside of the top wall 16, as can be appreciated from FIG. 4. The rack 82 includes an upper plate 86, the lower ends of the tubular mounts 84 being secured to the plate 86. The plate 86 is formed with a circular opening 88 as can be seen in FIG. 2. Marginally associated with the opening 88 are clips 90 and slots that provide an anchoring function presently to be referred to.

The upper plate 86 additionally includes vertically-depending side flanges 92 constituting side walls, a rear wall 93 and outwardly-issuing horizontal flanges 94 at the lower ends of the flanges 92, all as can be clearly perceived in FIG. 2. The flanges 94 have mounting holes 96 formed therein. The rack 82 additionally includes a lower plate 98 that supports the pan or tray when inserted into the oven. The lower plate 98 is formed with a circular opening 100 so that the heat generated by the chandelier bulb 40 can flow upwardly by convection into direct contact with the utensil when resting on the plate 98, the plate 98 performing a support function for the pan or tray. The rack 82 forms a confined compartment that is open at the front for the acceptance of the material to be heated. It will be noted that a downwardly offset flange 102 extends circumferentially around the opening 100. Still further, several ears 104 are struck from the sheet material constituting the plate 98 which interrupt the continuity of the flange 102 for a purpose described immediately below.

In order to make extremely efficient use of the heat generated by the chandelier-type bulb 40, a parabolic reflector 106 of crinkled aluminum sheeting is employed. The reflector 106 is formed with an upper outturned flange 108 that is engageable with the down set flange 102 so as to suspend the reflector 106 from the underside of the plate 98. The ears 104 prevent upward movement of the reflector's flange 108. The reflector 106 includes a curved wall 110 that imparts the parabolic configuration thereto, the reflector 106 having an opening 112 at the bottom thereof so that the chandlier-type bulb 40 can extend upwardly through the opening 112 into the confines of the reflector 106, all as clearly pictured in FIG. 4.

Recapitulating at this stage, it will be appreciated that the baking portion of the chamber is formed within the confines of the rack 82. In this regard, the rack 82 is positioned at the proper height so that the heat from the chandelier bulb 40 rises, passing through the opening 100 in the lower plate 98 and impinging directly on the pan or tray that is at that time resting on the plate 98. Stated somewhat differently, it is the region directly encompassed by the rack 82 that constitutes the cooking region.

Inasmuch as the interior of the casing 14, namely the region embraced by the rack 82, reaches baking temperatures on the order of 325° to 350° F., it is important that the child not burn herself. Therefore, a guard mechanism 114 is employed that is comprised of two bimetallic strips or arms 116 that are anchored at one end by the previously mentioned clips 90 to the underside of the upper plate 86 of the rack 82. The bimetallic strips or arms 116 are formed with curled clip ends 118 that support a gate or lock bar 120. The gate or lock bar 120 includes a panel portion 122 having integral hinge pins 124 issuing laterally therefrom, the hinge pins being received in the curved ends 118 of the bimetallic strips or arms 116. For the sake of completion, there are hinge guards 126 that snap in place to maintain engagement of the pins 124 in the curled ends 118 of the bimetallic strips or arms 116. All that need be understood at this stage is that the bimetallic strips or arms 116 flex downwardly when subjected to a sufficient amount of heat so as to move the gate or locking bar 120 into an obstructive relationship with the opening at the front of the rack 82, the opening being identified by the reference numeral 82*a*; more will be said hereinafter concerning the purpose and functioning of the guard mechanism that has been denoted by the reference numeral 114 and which includes the bimetallic strips or arms 116 and the gate or locking bar 120.

In order to provide a visual indication of the temperature existing within the oven, one end of the panel 122 of the gate or bar 120 is provided with a downwardly-depending integral arm 128 having a forwardly-projecting lower end portion 130 on which a gauge 132 in the form of an arrow is attached. The forwardly-projecting end portion 130 moves within a vertical slot 134. Inasmuch as the guard mechanism 114, more particularly its gate or bar 120 moves downwardly when the bimetallic strips or arms 116 are heated sufficiently, a dual utilization of this movement is made use of by reason of the arms 128 moving in unison with the panel 122. Stated somewhat differently, as the bimetallic strips or arms 116 flex so as to move their forward ends downwardly to move the gate into juxtaposition with the rack 82, the gauge 132 moves downwardly from an upper "cool" position to a lower "hot" position. Its downward movement thus signifies the temperature within the oven 10 and more specifically that of the rack 82 on which the material being heated has been placed.

In a commercial embodiment of the invention, an oven pan is provided with a spatula-like handle that enables the child to push such a pan into the oven 10, more specifically onto the rack 82, so that the pan then is supported on the rack's lower plate 98. As already indicated, it is not necessary to show the pan, and the same also holds true for the handle. However, the opening or entrance through which the pan is inserted and removed, together with its contents, has been labeled 136. Projecting forwardly from the entrance 136 is a rectangular tube or tunnel forming a guide 138. The broad bottom wall 138*a* of the guide 138 facilitates the insertion and removal of the pan (or tray) in that such a utensil can be slid over the bottom wall 138*a* and the continued advancement of the pan results in the pan moving onto the rack 82 at which time it can be readily heated when the upstanding chandelier bulb 40 is energized. It should now be fully understood that the gate or lock bar 120, owing to its position intermediate the entrance 136 and the forward end of the rack 82, produces an obstructive interference that will prevent the insertion of the pan or other utensil when the oven is too hot and the child is likely to be burned. It will be recalled that the bimetallic strips or arms 116 flex downwardly so as to move the gate or locking bar 120 into registry with the entrance 136, thereby blocking the entrance 136 so that items cannot be put in or taken out of the oven 10.

The manner in which the slide switch 48 is opened and closed, more specifically, the manner in which its operating button 50 is shifted up and down will now be described; it will be recalled that when the button 50 is up, then the switch 48 is open and when the button 50 is down, then the switch 48 is closed. Therefore, reference will be made to the front wall 18 of the casing 14 where it will be perceived that there is a central small hole 140 flanked by a pair of arcuate slots 142. As perhaps also best understood from FIG. 2, there is a switch plate 144 having a tubular bushing 146 so that the switch plate 144 can be rotated about an axis provided by the central hole 140. The switch plate 144 further includes a sector portion 148 having an arcuate slot 150 formed therein, the arcuate slot 150 being slightly eccentric relative to the tubular bushing 146. While the eccentricity imparted to the arcuate slot 150 is not readily perceptible, it will be understood that the left end of the slot 150 is spaced farther in a radial direction from the tubular bushing 146 than the right end of the slot 150. The switch plate 144 also includes a vane or blade 152. Still further, it will be noted from FIG. 2 that there are two holes 154 formed in the switch plate 144.

A manually-rotatable knob 156 has an embossed or raised rib 158 at the front and two pins 160 projecting rearwardly so that the pins pass through the two holes 154 in the switch plate and also ride in the previously mentioned arcuate slots 142 to limit the rotation of the switch plate 144 to 90°. From FIG. 4, a screw 162 can be seen which serves as a shaft about which the knob 156 and switch plate 144 rotate. The vane or blade 152 functions as a guard as will soon become manifest when presenting the operation of the oven 10 immediately below.

Having presented the foregoing description, the manner in which our toy electric oven 10 functions should be readily understandable. Nonetheless, a brief operational sequence outlining the procedures that the child should follow will be of assistance in appreciating the full benefits to be derived from a practicing of the invention.

Figure 3:
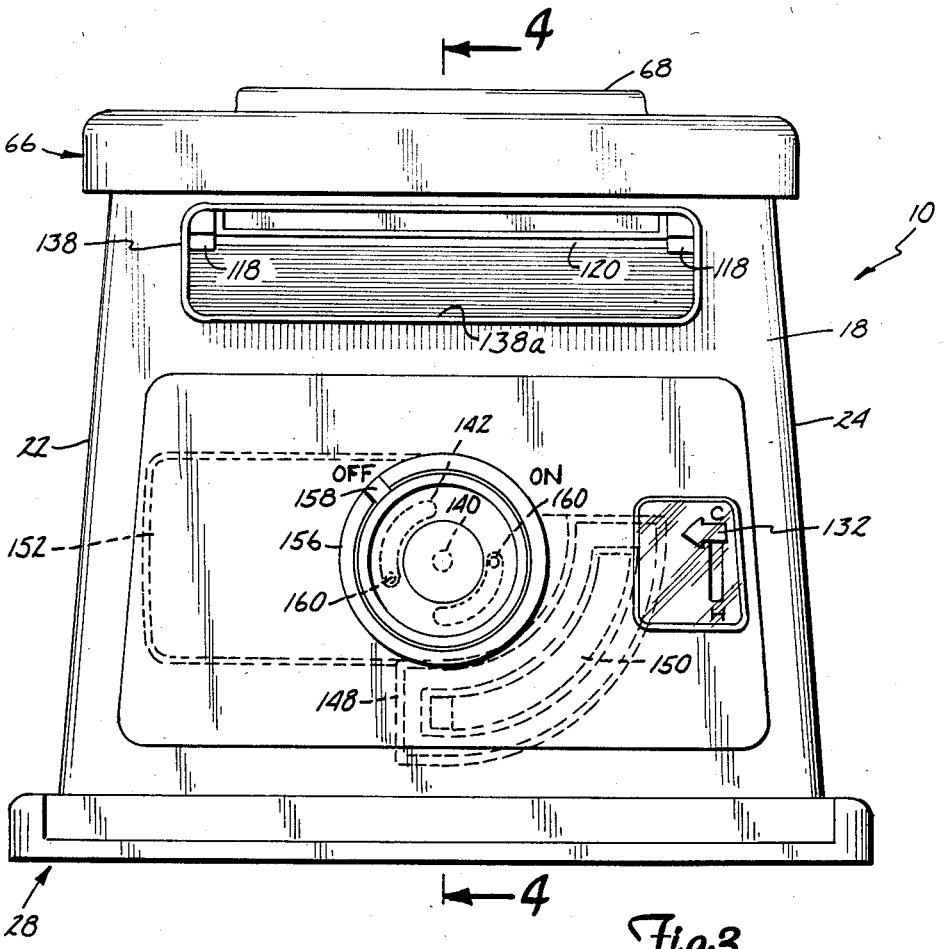
FIG. 3 is a front elevational view of the toy oven shown in FIG. 1, the view being on a somewhat larger scale and depicting the oven prior to its having electric power supplied thereto.

It will be well to refer initially to FIGS. 1 and 3 because both of these figures picture the toy oven 10 in a de-energized condition before power is supplied. In this regard, it can be seen from the position of its rib 158 that the knob in FIG. 3 has been rotated into an off position. As better understood from FIG. 4, it will there be observed that the operating button 50 belonging to the slide switch 48 is uppermost; in other words, when the operating button is up, the switch is off and power is not being supplied to the oven 10. It can also be noticed that the gauge 132 signifies that the temperature within the oven 10, more specifically, the region where the rack 82 is located, is cool because the gauge 132 is at its highest point, as would be expected prior to supplying electric power to the oven 10. Also, as can be understood from FIGS. 3 and 4, the guard mechanism 114 is such that the gate or lock bar 120 is raised. The gate or lock bar 120 can be seen from one end in FIG. 4, and the lower edge thereof can be seen in FIG. 3.

It will also be appreciated from FIG. 3 that the switch plate 144 has been rotated so that its vane or blade 152 is horizontal. This condition appears in phantom outline in FIG. 3.

The toy electric oven 10 under these conditions is in readiness to begin the baking process. Depending upon the item to be cooked, the child puts the material in a pan or other utensil, and moves the pan, which has not been illustrated, inwardly through the projecting tubular guide 138. It is not intended that the child use its fingers to effect a complete introduction of the pan into the cooking chamber defined by the rack 82. In this respect, it has already been mentioned that an appropriate handle, also not shown, is supplied in practice to do this.

Figure 5:
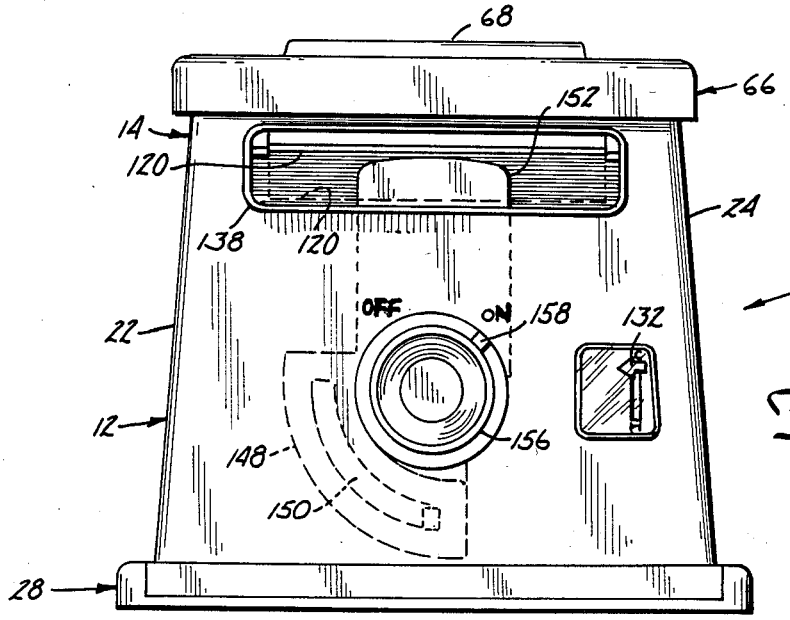
FIG. 5 is another front elevational view of the toy oven, the view being on a somewhat smaller scale than FIG. 3 but showing the oven shortly after its switch has been closed to supply power to the oven.

At any rate, once the pan has been placed onto the lower plate 98 of the rack 82 with the material to be heated therein, the child rotates the knob 156 from the off position in FIG. 3 to the on position in FIG. 5. Such action immediately supplies electric power to the vertically-oriented chandelier bulb 40. Owing to the fact that the vane or blade 152 at this time is moved into a twelve o'clock position so that its free end portion is in an obstructive relation with the entrance 136, such a blocked condition prevents the child from gaining access to the utensil that is now on the rack 82 where the baking occurs. If the child should decide that the contents in the utensil should be changed or rearranged, access can immediately be had by simply rotating the knob 156 in a counterclockwise direction from the position in which it appears in FIG. 5 back to the position shown in FIG. 3. This will reopen the entrance 136 because of the concomitant shifting of the vane or blade 152 out of registry with the entrance 136 so that the utensil can under these circumstances be taken out.

On the other hand, if the switch 48 remains closed by virtue of the knob 156 remaining in the position in which it has been moved as far as FIG. 5 is concerned, there will be a rapid build-up of heat from the chandelier bulb 40. The parabolic reflector is instrumental in reflecting the heat from the bulb 40 onto the underside of the utensil because the lower plate 98 of the rack 82 has the opening 100 therein, thereby enabling the heat to impinge directly on the utensil during the baking process.

Figure 4:
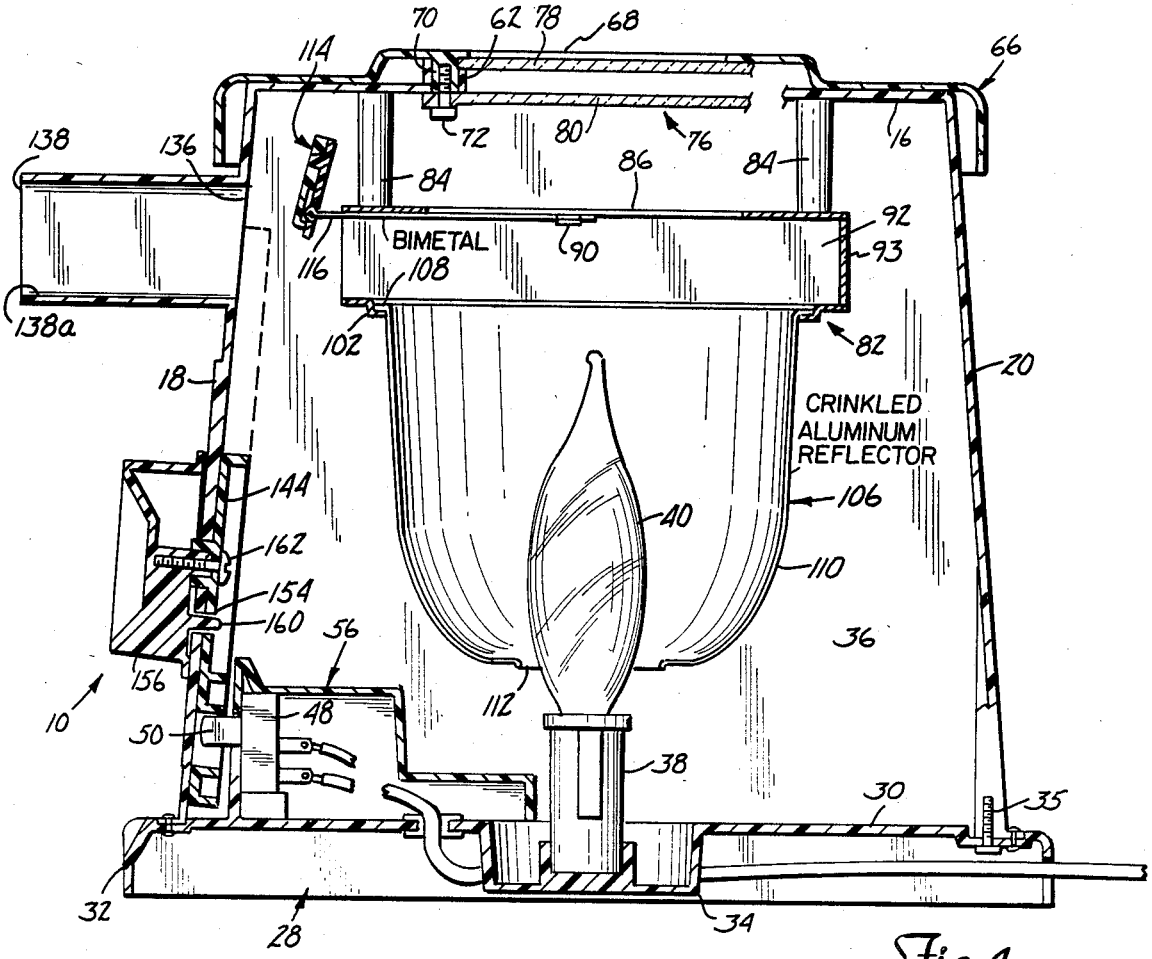
FIG. 4 is a vertical sectional view taken in the direction of line 4—4 of FIG. 3.

It will be appreciated that before the power is even turned on, the guard mechanism 116 is in a position such that its gate or locking bar 120 is raised so as not to block or obstruct the entrance 136. Thus, the lower edge of the gate 120 can be seen through the guide 138 and entrance 136 in FIG. 3. Also, during the early portion of the heating that occurs when the switch 48 is closed, as can be understood by the position of the knob in FIG. 5, there has not been a sufficient elapse of time for the gate or locking bar 120 to move downwardly into an obstructive position. Hence, the solid line position of the gate 120 in FIG. 5 corresponds to the solid line position thereof in FIG. 3. However, the dotted line position of the gate 120 in FIG. 5 represents the reaching of an elevated temperature within the upper portion of the oven's chamber 36 where the rack 82 is located that should prevent removal of the pan or other utensil irrespective of whether the knob 156 has been rotated in a direction to open the switch 48; this would cause the obstructive relationship provided by the vane or blade 152 to no longer exist because the vane 152 would again assume the phantom outline position appearing in FIG. 3. The solid line position of the gate or locking bar 120, as it appears in FIG. 4, is the same as its solid line position in FIG. 3 and also its solid line position in FIG. 5. Thus, the solid line position of the gate 120 in FIG. 5 indicates an early portion of the baking period, whereas the phantom outline position of the gate 120 in FIG. 5 indicates a later period during the baking process.

Figure 6:
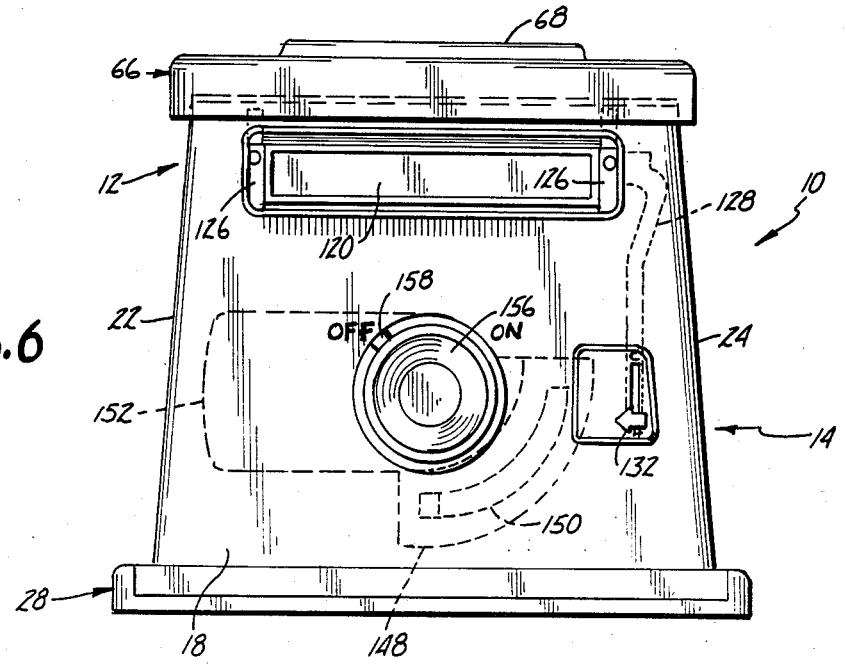
FIG. 6 is a front elevational view corresponding to FIG. 5 but with the switch open and before the oven has had a chance to cool.
Figure 7:
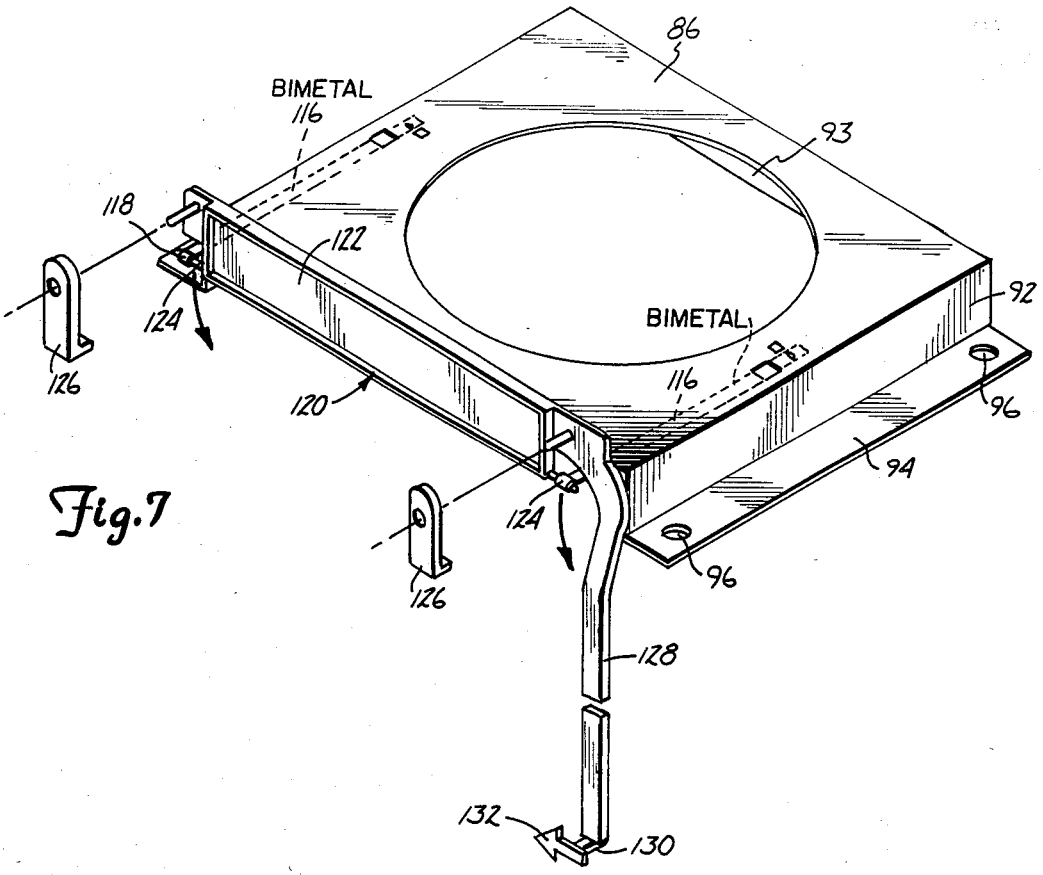
FIG. 7 is a perspective view taken in the same direction as FIG. 2 but illustrating to better advantage certain components made use of in preventing access to the baking chamber when the baking chamber is at an elevated temperature.

Whenever the cooking has been completed, then the child turns off the power, doing so by rotating the knob 156 back to the position in which it appears in FIG. 6. This is the same position that it is shown in in FIG. 3. However, even though the cooking process as been completed when the child rotates the knob 156 so as to open the switch 48, there is still a considerable amount of residual heat remaining. The child may very well wish to rely upon the residual heat to complete the baking operation. Nonetheless, because the baking chamber defined by the rack 82 is too hot to permit the removal of the utensil, the guard mechanism 116, more specifically, its gate or lock bar 120 remains in its lower or blocking relationship with the entrance 136, thereby preventing removal of the utensil until the oven 10 has cooled sufficiently. The child is visually apprised of the too-hot temperature by the gauge 132 at the lower end of the arm 128. It will be recalled that the arm 128 is integral with the gate 120, moving in unison therewith. Consequently, the child does not have to peer into the rectangular guide 138 to see whether the gate 120 is down or closed. All that the child need do is to view the indicator gauge 132. If it is up, then the oven 10 is cool; if down, the oven 10 is hot.

As long as the power is turned off, there is a gradual cooling of the rack 82 within the upper portion of the chamber 36. As the interior in the vicinity of the rack 82 cools, then the bimetallic strips or arms 116 of the guard mechanism 114 also cool. As they cool, the free ends 18 thereof again rise. Since the gate 120 is carried at the free ends of the bimetallic strips or arms 116, then the gate 120 also rises, that is, opens, and the indicator gauge 132 also rises. When this happens, the gauge 132, being uppermost, tells the child that it is safe to withdraw the utensil, and the gate 120 in its raised or open condition affords access through the entrance 136 so that the utensil can be physically taken out.

At all times the child can look into the baking portion of the chamber 36, doing so through the agency of the window 76. Not only can a child readily ascertain whether a pan is already within the oven 10, but the child can see whether the contents within the pan once it has been inserted remain properly distributed for the most appropriate heating. In other words, there are some items, particularly of a novelty nature, that must remain arranged so that the particles thereof melt and fuse to preserve a desired pattern. Should the original emplacement of the fusable particles be jostled when the child is inserting the pan containing such particles, the child can ascertain whether the pattern has been disturbed. Still further, during the entire baking operation, the child can see what is happening. When actual food is being cooked, the child can essentially monitor the process and readily determine when the baking operation has been completed.

It is of considerable importance to appreciate that the invention allows a lower-wattage bulb to be employed than heretofore. In the past, a 75 watt bulb or greater has been used and has also been horizontally oriented in the baking chamber. With the bulb vertical in our oven 10 and in the form of a chandelier bulb, only a 60 watt rating is needed when employing this type of bulb. Being vertical, the situation lends itself to utilizing the parabolic reflector 106. In this way, virtually all of the heat generated by the chandelier bulb 40 is both directed and reflected upwardly onto the underside of the utensil when resting on the lower plate 98 of the rack 82.

It should also be appreciated that an oven such as the oven 10 more closely resembles a real oven in that only one entrance 138 is employed via which a pan or tray is initially inserted and subsequently withdrawn. Even though but a single entrance 138 is utilized, there is no sacrifice in safety insofar as the instant invention is concerned, for a number of safety features are incorporated into the oven 10, playing a very important role in assuring that the child will not be injured. Even the presence of the thermal switch 54 furnishes an added safety precaution because it will completely disconnect the power being supplied to the oven 10, doing so when the slide switch 48 is closed.

We claim:

1. A toy electric oven comprising a housing having a baking chamber provided with an entrance thereto, means for electrically heating said chamber, gate means, and means responsive to temperature within said chamber for causing said gate means to move and at least partially block said entrance when said chamber is above a certain temperature.

2. A toy electric oven in accordance with claim 1 in which the movement of said gate means is representative of the temperature within said chamber and including signal means connected to said gate means and movable therewith for denoting generally the temperature within said chamber as determined by the movement of said gate means.

3. A toy electric oven in accordance with claim 2 including additional means for at least partially blocking said entrance when electric power is being supplied to said heating means, and switch means actuated by said additional means to cause power to be supplied to said heating means only when said additional means is at least partially blocking said entrance.

4. A toy electric oven in accordance with claim 3 in which said heating means includes a vertically-oriented chandelier bulb.

5. A toy electric oven in accordance with claim 4 in which said bulb has a base and including a parabolic reflector extending upwardly from the base of said bulb.

6. A toy electric oven in accordance with claim 5 in which said housing has a top and in which said chamber has an interior, the oven including window means in the top of said housing for viewing the interior of said chamber.

7. A toy electric oven in accordance with claim 6 including rack means above said bulb for supporting a utensil thereon when inserted into said chamber via said entrance.

8. A toy electric oven in accordance with claim 7 in which said rack means includes an upper and lower plate, the lower of said plates having an opening therein so that heat can be directed upwardly from said bulb onto a utensil supported thereon, and the upper of said plates having an opening therein so that said utensil when supported on said lower plate can be viewed from above.

9. A toy electric oven comprising means providing a confined baking chamber having a single entrance via which items to be heated can be inserted and withdrawn, means for heating said chamber to produce a change in temperature in said chamber, means for obstructing said entrance, said obstructing means normally being in a non-obstructing relation with said entrance, and means responsive to said change in temperature for moving said obstructing means into an obstructing relating with said entrance when said chamber reaches a predetermined temperature to prevent insertion and subsequent withdrawal of an item.

10. A toy electric oven in accordance with claim 9 including means connected to and movable with said obstructing means for providing a visual indication generally representative of the temperature within said chamber.

11. A toy electric oven comprising a housing forming a chamber therein having upper and lower portions, an upright lamp socket in the lower portion of said chamber, a chandelier light bulb extending vertically upwardly from said socket, a parabolic reflector laterally surrounding said chandelier light bulb for reflecting heat from said chandelier light bulb upwardly, said reflector having substantially vertical sides and having a lower portion curving inwardly toward a lower portion of said chandelier light bulb, said lower portion of said reflector having an opening therein closely adjacent the lower portion of said chandelier light bulb, and means in the upper portion of said chamber for holding a utensil during a baking operation including a first plate having an opening therein located vertically above said light bulb and including a second plate spaced above said first plate, said second plate also having an opening therein in alignment with said light bulb.

12. A toy electric oven in accordance with claim 11 in which said housing includes an entrance through which a utensil can be inserted and withdrawn, the entrance being horizontally aligned with said utensil-holding means.

13. A toy electric oven in accordance with claim 12 in which said utensil-holding means is closed at its sides and back but open at its front so that a utensil inserted through said entrance can enter said utensil-holding means.

14. A toy electric oven in accordance with claim 13 including thermally actuated means for obstructing said entrance.

15. A toy electric oven in accordance with claim 11 including window means in the upper portion of said housing, said window means being above and aligned with the opening in said second plate to provide an unobstructive viewing of an item being heated.

16. A toy electric oven in accordance with claim 12 including first and second guard means for at least partially blocking said entrance, manually movable means for furnishing power to said lamp socket when moved sufficiently in one direction, means controlled by said power-furnishing means for actuating said first guard means into its blocking position when said manually movable means is moved sufficiently in said one direction to supply power to said lamp socket, and means responsive to temperature in said chamber for actuating said second guard means into its blocking position when said chamber is above a certain temperature.

17. A toy electric oven in accordance with claim 16 including switch means for furnishing power to said lamp socket, manually-operated means for closing and opening said switch means, and means connecting said manually-operable switch means to said first guard means.

18. A toy electric oven in accordance with claim 16 in which said actuating means includes thermostatic means responsive to said certain temperature within said chamber and also includes means connecting said thermostatic means to said second guard means.

19. A toy electric oven in accordance with claim 18 including switch means for furnishing power to said lamp socket, manually-operable means for closing and opening said switch means, means connecting said manually-operable switch means to said first guard means, said thermostatic means being responsive to the temperature within said chamber, and means connecting said thermostatic means to said second guard means.

20. A toy electric oven comprising a housing forming a chamber therein having upper and lower portions, said upper portion having an entrance, an upright lamp socket in the lower portion of said chamber, a light bulb extending vertically upwardly from said socket, and means in the upper portion of said chamber for holding a utensil during a baking operation, a slide switch in circuit with the lamp socket, a rotatable knob spaced from said slide switch, and means connecting said knob to said slide switch so that said switch can be closed and opened by rotation of said knob, said connecting means including a switch plate having an arcuate slot therein and a guard portion, said slide switch having an operating button projecting into said slot and said slot having a sufficient amount of eccentricity so that when said knob is rotated in one direction said button is moved from its open position to its closed position and said guard portion is moved into an obstructive relation with said entrance, and whereby when said knob is rotated in an opposite direction said button is moved from its said closed position to its said open position.

21. A toy electric oven in accordance with claim 20 in which said guard portion constitutes a radially-directed vane, one end of said vane being rotatable into said obstructive relation with said entrance.

22. A toy electric oven in accordance with claim 21 including a forwardly-projecting rectangular tubular guide for facilitating insertion and withdrawal of a utensil via said entrance.

23. A toy electric oven comprising a housing having a top and forming a chamber therein having upper and lower portions, a lamp socket in the lower portion of said chamber, means for holding an item to be heated in the upper portion of said chamber, said housing having an entrance in alignment with said holding means so that an item to be heated can be inserted and withdrawn via said entrance, a gate movable into obstructive relationship with said entrance, thermostatic means for actuating said gate into said obstructive relationship, switch means, means for operating said switch means to supply electric power to said socket, means actuated by said switch-operating means to obstruct said entrance when said switch means is actuated into a closed position to supply power to said socket, an overload switch in circuit with said socket so as to interrupt the supplying of power to said socket if a temperature within said chamber reaches an excessive value, and window means in the top of said housing so that an item placed in the upper portion of said chamber can be viewed before, during and after heating thereof.

24. A toy electric oven comprising means providing a confined baking chamber having a single entrance via which items to be heated can be positioned and withdrawn, means for obstructing said entrance when said chamber reaches a predetermined temperature to prevent insertion and subsequent withdrawal of an item, a lamp socket, switch means in a circuit with said lamp socket, manual means for closing said switch means to complete a circuit through said lamp socket, and additional means rotatable by said manual means for obstructing said entrance when said switch means is closed to prevent insertion and subsequent withdrawal of an item.

25. A toy electric oven comprising a housing forming a chamber therein having upper and lower portions, an upright lamp socket in the lower portion of said chamber, a light bulb extending vertically upwardly from said socket, and means in the upper portion of said chamber for holding a utensil during a baking operation, said utensil-holding means including a first plate having an opening therein located vertically above said light bulb and having a second plate spaced above said first plate, said second plate also having an opening therein in alignment with said light bulb, said housing including an entrance through which a utensil can be inserted and withdrawn, the entrance being horizontally aligned with said utensil-holding means, said utensil-holding means being closed at its sides and back but open at its front so that a utensil inserted through said entrance can enter into said utensil-holding means, guard means movable into an obstructive position relative to said entrance when said chamber becomes sufficiently heated, said guard means including a gate, and thermostatic means responsive to heat in said chamber for moving said gate into said obstructive relation with said entrance.

26. A toy electric oven in accordance with claim 25 in which said gate constitutes a rectangular plate and said thermostatic means includes a pair of forwardly-directed and laterally-spaced bimetallic arms, said bimetallic arms being fixedly anchored within said chamber at one end and having their free ends connected to said gate.

27. A toy oven comprising a housing forming a chamber having an entrance, means for heating said chamber, guard means adjacent said entrance movable from a nonobstructive position to an obstructive position relative to said entrance, whereby said guard means blocks said entrance, and temperature responsive means for causing said guard means to move from its said nonobstructive position into its said obstructive position when said chamber becomes sufficiently heated by said heating means so that items cannot be put in and taken out of said chamber.

* * * * *